US008714707B2

(12) United States Patent
Kanda et al.

(10) Patent No.: US 8,714,707 B2
(45) Date of Patent: May 6, 2014

(54) METHOD OF MAKING HOLE IN SUBSTRATE, SUBSTRATE, NOZZLE PLATE AND INK JET HEAD

(75) Inventors: Atsushi Kanda, Fujimi (JP); Junichi Takeuchi, Chino (JP)

(73) Assignee: Seiko Epson Corporation (JP)

( * ) Notice: Subject to any disclaimer, the term of this patent is extended or adjusted under 35 U.S.C. 154(b) by 0 days.

(21) Appl. No.: 13/494,423

(22) Filed: Jun. 12, 2012

(65) Prior Publication Data

US 2012/0327161 A1 Dec. 27, 2012

(30) Foreign Application Priority Data

Jun. 22, 2011 (JP) ..... 2011-138235

(51) Int. Cl.
*B41J 2/14* (2006.01)

(52) U.S. Cl.
USPC ..... 347/47

(58) Field of Classification Search
USPC ..... 347/47
See application file for complete search history.

(56) References Cited

U.S. PATENT DOCUMENTS

| | | | | |
|---|---|---|---|---|
| 4,007,464 | A * | 2/1977 | Bassous et al. | 347/47 |
| 2007/0081035 | A1 * | 4/2007 | Worsman et al. | 347/56 |
| 2010/0253743 | A1 | 10/2010 | Takeuchi | |

FOREIGN PATENT DOCUMENTS

| | | |
|---|---|---|
| JP | 2010-158822 | 7/2010 |
| JP | 2010-240852 | 10/2010 |

* cited by examiner

*Primary Examiner* — Stephen Meier
*Assistant Examiner* — Alexander D Shenderov
(74) *Attorney, Agent, or Firm* — Harness, Dickey & Pierce, P.L.C.

(57) ABSTRACT

A method of making a hole in a substrate having a first surface and a second surface opposing the first surface and on which the hole is formed, includes forming a first depression in which the first depression is formed at the first surface of the substrate; forming a film in which the film is formed at the first depression; forming a second depression in which the second depression is formed at a location opposing the first depression of the second surface; and forming a hole in which the film is removed, the first depression and the second depression communicate with each other and thereby the hole is formed, wherein the second depression includes a plurality of straight lines and arcs in a plan view.

6 Claims, 9 Drawing Sheets

METHOD OF MAKING HOLE IN SUBSTRATE, SUBSTRATE, NOZZLE PLATE AND INK JET HEAD

BACKGROUND

1. Technical Field

The present invention relates to a method of making a hole in a substrate and a substrate, and specifically relates to a method of making a hole using etching.

2. Related Art

An ink jet method is widely used where ink is discharged from an ink jet head as liquid droplets and various patterns are drawn. The ink jet head discharging the ink includes a nozzle plate where a plurality of nozzle holes are formed to discharge ink droplets and a flow path forming substrate where a discharge chamber and an ink flow path are formed to communicate with the nozzle holes. In the ink jet head, a drive unit applies pressure to the discharge chamber and the ink droplets are discharged from selected nozzle holes. As the drive unit, there is an electrostatic drive system using an electrostatic force, a piezoelectric drive system using a piezoelectric element, a drive system using a heater element and the like.

JP-A-2010-158822 discloses a method of assembling a nozzle plate and a flow path forming substrate. According to the related art, a pair of positioning holes are disposed at the nozzle plate. One of the positioning holes is a regular octagonal reference hole and the other thereof is a long hole which is long in one direction. Thus, the positioning holes are also positioned at the flow path forming substrate. After aligning the positions by inserting a pin to the positioning holes of the nozzle plate and the flow path forming substrate, the nozzle plate and the flow path forming substrate are assembled. Accordingly, the nozzle plate and the flow path forming substrate can be assembled with high positional accuracy.

JP-A-2010-240852 discloses a method of manufacturing a nozzle plate. According to the related art, nozzle holes are configured such that a first nozzle of an outside air side and a second nozzle of a discharge chamber side are arranged coaxially. The diameter of the first nozzle is smaller than that of the second nozzle. Thus, after the first nozzle is formed on a surface of a substrate, a protection film is formed on the first nozzle. The protection film includes a function for separating front and back sides of the substrate, and the protection film is referred to as a separation film below. Next, the substrate is thinned by grinding the backside of the substrate. Subsequently, the second nozzle is formed at the backside of the substrate.

At this time, etching is performed on the substrate until the separation film is exposed. Next, the separation film, which is positioned between the second nozzle and the first nozzle, is removed. The nozzle holes are manufactured in the step and thereby the length of a hole of the first nozzle is formed with the high positional accuracy.

In order to manufacture the nozzle plate with good productivity, a method is considered where the positioning hole is formed concurrently with the first nozzle forming step and the second nozzle forming step. In other words, a portion of the positioning hole is formed during the first nozzle forming step. Next, the separation film is arranged and the substrate is thinned. Subsequently, a remaining portion of the positioning hole is formed during the second nozzle forming step. In the step, etching gas flows on the backside of the substrate and cooling gas flows on the frontside of the substrate. The etching gas and the cooling gas are separated by the separation film. Thus, when the separation film is exposed to the backside, the separation film receives pressure corresponding to the difference between pressure of the etching gas and pressure of the cooling gas. Accordingly, when the separation film is torn, becomes waste and attaches to the nozzle plate or a manufacturing apparatus, normal etching may not be performed and flaws may occur. A manufacturing method is preferable in which the hole separation film is not easy to tear in the process of manufacturing a hole where a plurality of holes of different sizes overlap.

SUMMARY

An advantage of some aspects of the invention is to solve at least a part of the problems described above, and the invention can be implemented as the following forms or application examples.

Application Example 1

This application example is directed to a method of making a hole in a substrate where a first surface and a second surface are opposite each other, including: forming a first depression at the first surface of the substrate; forming a separation film at the first depression; forming a second depression at a location opposing the first depression from the second surface to the separation film by flowing etching gas flows on the second surface; and removing the separation film positioned between the first depression and the second depression to form the hole which penetrates the first depression and the second depression. The second depression is a polygon in which sides intersect in an arc shape or a circle in a plan view.

According to this application example, the first depression is formed at the first surface of the substrate in the forming of the first depression and the separation film is formed at the first depression in the forming of the separation film. Cooling gas flows on the first surface and the etching gas flows on the second surface in the second depression forming step. Thus, the second depression is formed at the location opposing the first depression from the second surface to the separation film. In this step, the first depression and the second depression are separated by the separation film. Accordingly, the location where the etching gas flows can be limited to the second surface side. The separation film positioned between the first depression and the second depression is removed in the removing of the separation film. Accordingly, the first depression and the second depression are penetrated, and thereby the hole is formed on the substrate.

Pressure is applied to the separation film by the etching gas in the forming of the second depression. Thus, the separation film is pressurized at the high pressure side. Accordingly, the separation film extends. Angle portions are stretched compared to side portions when the second depression is the polygon in the plan view. Accordingly, a location where the inside stress is high and a location where the inside stress is low are formed in the separation film. In the embodiment, locations where the sides of the polygon intersect become arcs. Accordingly, the arc portions cannot be easily stretched compared to a case where the locations where the sides intersect are angular. Thus, the difference between the location where the inside stress of the separation film is high and the location where the inside stress thereof is low can be decreased. The difference between the location where the inside stress of the separation film is high and the location where the inside stress thereof is low can be decreased even in a case where the second depression is the circle in the plan view. As a result, the separation film cannot be easily torn.

Application Example 2

This application example is directed to the method of making a hole in a substrate according to the above application example, wherein the second depression of the substrate is positioned inside the first depression in the plan view.

According to this application example, the second depression of the substrate is positioned inside the first depression in the plan view. The separation film is formed at the first depression so that the first surface side of the second depression reaches the separation film in the forming of the second depression. At this time, pressure is applied to the separation film formed in a planar shape. Meanwhile, when the second depression is positioned at the location of the first depression and outside the first depression in the plan view of the substrate, the first surface side of the second depression becomes an outside portion of the first depression and the separation film. Accordingly, a side surface of the first depression and a surface of the second surface side of the first depression intersect and the separation film of the intersecting location is included in the first surface side of the second depression. At this time, stress is easily concentrated in the location of the separation film where the side surface of the first depression and the surface of the second surface side of the first depression intersect and thereby the separation film is easily torn. Compared to this, in this application example, pressure is applied to the separation film formed in the planar shape and thereby the stress concentration cannot easily occur and the separation film cannot easily be torn.

Application Example 3

This application example is directed to the method of making a hole in a substrate according to the above application example, wherein the hole is a positioning hole in which a cylindrical pin is inserted, and the polygon is a rectangular shape and a diameter of the arc is shorter than a width of the rectangular shape in the short side direction.

According to this application example, the pin is inserted into the hole and is used in the positioning of the substrate. Thus, the diameter of the arc is shorter than the width of the rectangular shape in the short side direction. Thus, a diameter of the pin is approximately set to the same length as the width of the rectangular shape in the short side direction. Accordingly, when the pin approaches a short side of the rectangular shape, the pin comes into contact with the short side without contacting the arc. As a result, the hole can move the pin to all locations of the rectangular shape in the longitudinal direction.

Application Example 4

This application example is directed to the method of making a hole in a substrate according to the above application example, wherein the substrate has nozzle holes at locations which are different from the location of the hole, and the hole and the nozzle holes are formed in the same step.

According to this application example, the substrate has the nozzle holes. Thus, the hole and the nozzle holes are manufactured in the same step. Accordingly, the hole and the nozzle holes can be manufactured with good productivity compared to when the hole and the nozzle holes are manufactured in separate steps respectively.

Application Example 5

This application example is directed to a substrate which includes a substrate formed of silicon or glass; a depression disposed at the substrate; and a hole positioned inside the depression of the substrate in a plan view. The hole is a polygon in which sides intersect in an arc shape or a circle in a plan view.

According to this application example, the substrate is formed of silicon or glass. Thus, the depression is formed on the substrate. The hole is formed inside the depression of the substrate in the plan view. The depression and the hole can be formed by the etching and specifically, can be formed with high positional accuracy by dry etching. At this time, first, the depression is covered and the separation film is formed after the depression is formed. Next, the separation film is removed after other depressions are formed at the location opposing the depression and thereby the hole penetrating the substrate can be formed. At this time, the shape of the hole is the polygon in which sides intersect in an arc shape or the circle in the plan view and thereby the substrate can be formed in order not to tear the separation film.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
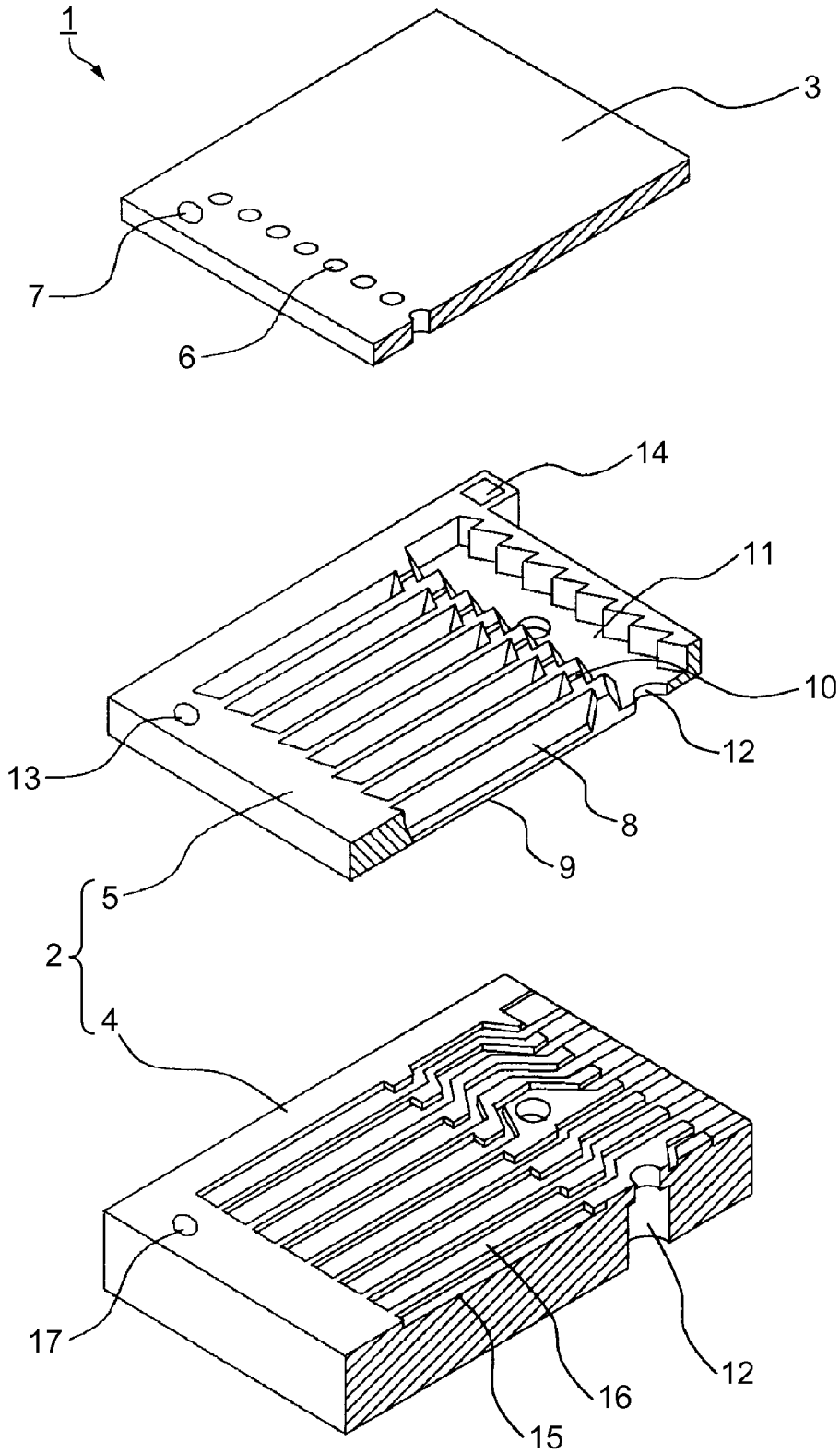
FIG. 1 is a schematic exploded perspective view illustrating a configuration of a liquid droplet discharge head.

In the embodiment, characteristic examples of a liquid droplet discharge head, a nozzle plate that is used in the liquid droplet discharge head and manufacturing of the nozzle plate are described according to FIGS. 1 to 8. Hereinafter, the embodiments are described with reference to the drawings. In addition, the size of each member in the drawings is shown scaled to a recognizable degree for clarity.

Embodiment

FIG. 1 is a schematic exploded perspective view illustrating a configuration of a liquid droplet discharge head and a portion thereof is illustrated in cross-section. As shown in FIG. 1, a liquid droplet discharge head 1 is mainly configured of a flow path forming substrate 2 and a nozzle plate 3 as a substrate, and the nozzle plate 3 is fixed on the flow path forming substrate 2. The flow path forming substrate 2 is mainly configured of an electrode substrate 4 and a cavity substrate 5, and the cavity substrate 5 is fixed on the electrode substrate 4.

A plurality of nozzle holes 6 and a positioning hole 7 as a hole are arranged at the nozzle plate 3. The nozzle holes 6 are arranged in one line, however, may be arranged in two or more lines and may correspond to a shape of the liquid droplet discharge head 1. The material of the nozzle plate 3 may have stiffness, and silicon, glass, metal or the like can be employed. In the embodiment, for example, the material of the nozzle plate 3 employs a silicon substrate.

Pressure chambers 8, which communicate with the nozzle holes 6, are formed at the cavity substrate 5. The number of the pressure chambers 8 is the same as that of the nozzle holes 6 and the pressure chambers 8 are rectangular solids that are long in one direction. The longitudinal direction of the pressure chambers 8 is orthogonal to the arrangement direction of the nozzle holes 6. Thus, the nozzle plate 3 functions as a lid of the pressure chambers 8 and the nozzle holes 6 are arranged at one end of the pressure chambers 8 in the longitudinal direction.

A vibration plate 9 is disposed at a location opposing the nozzle plate 3 in each pressure chamber 8. The cavity substrate 5 for example, can use the silicon substrate to the material thereof. Thus, a boron diffusion layer which diffuses boron of high density is formed at the location which becomes the vibration plate 9. The cavity substrate 5 is formed using an anisotropic wet etching method by alkaline and the thickness of the vibration plate 9 can be formed with high precision by etching stop technology using the boron diffusion layer.

A fine groove-shaped orifice 10 is disposed at a side surface of the pressure chamber 8 at an end other than a side of the nozzle holes 6 in the longitudinal direction. Thus, a reservoir 11 which communicates with a plurality of the orifices 10 is disposed. The reservoir 11 is a flow path to supply ink to the pressure chambers 8 and is a location that accumulates the ink. Thus, the nozzle plate 3 functions as a lid of the reservoir 11 and an ink introducing hole 12 is disposed at a surface opposing the electrode substrate 4 at the reservoir 11.

A positioning hole 13 is disposed at a location opposing the positioning hole 7 at the cavity substrate 5. Thus, the positioning hole 7 and the positioning hole 13 are arranged to connect to each other. A common electrode 14 is disposed at an angle of the reservoir 11 side in the cavity substrate 5 and a voltage can be applied to the cavity substrate 5.

The material of the electrode substrate 4 for example, can be made of the glass. Thus, a rectangular solid-shaped depression 15 is formed which is long in one direction at a location opposing the pressure chamber 8. Thus, the longitudinal direction of the depression 15 is the same as the longitudinal direction of the pressure chamber 8. An individual electrode 16 which is formed of ITO (Indium Tin Oxide) is disposed inside the depression 15. In the electrode substrate 4, a positioning hole 17 is disposed at a location opposing the positioning hole 13. Thus, the positioning hole 13 and the positioning hole 17 are arranged to connect to each other. Accordingly, the positioning hole 7, the positioning hole 13 and the positioning hole 17 can be connected.

Figure 2A:
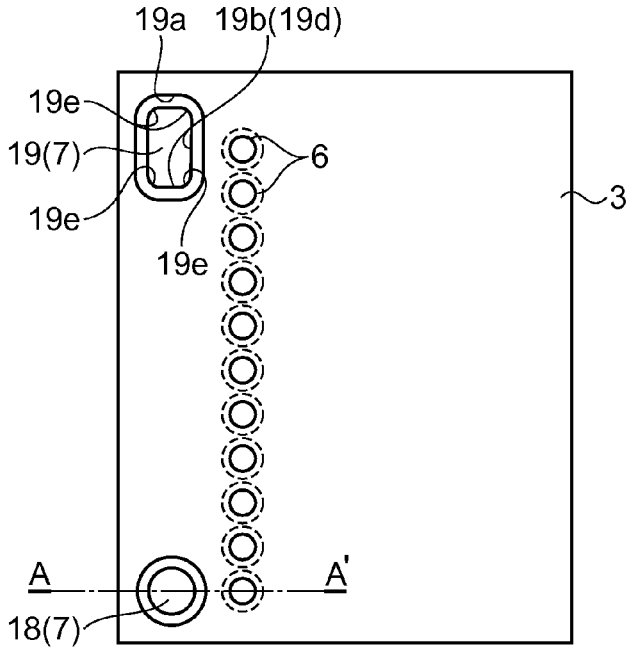
FIG. 2A is a schematic plan view illustrating a nozzle plate.
Figure 2B:
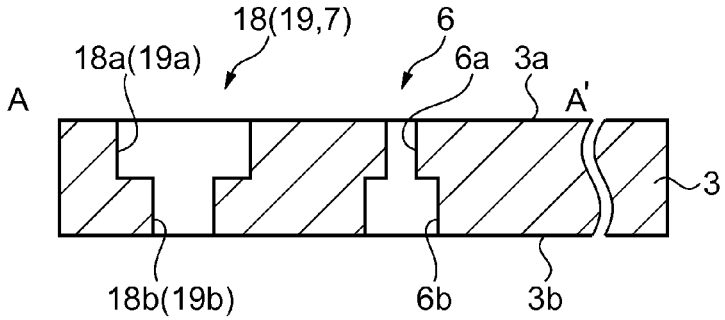
FIG. 2B is a schematic cross-sectional view illustrating the nozzle plate and FIG. 2C is a schematic cross-sectional view illustrating a structure of an ink jet head.

FIG. 2A is a schematic plan view illustrating the nozzle plate 3. FIG. 2B is a schematic cross-sectional view illustrating the nozzle plate 3 and illustrates a cross section taken along A-A' line in FIG. 2A. As shown in FIG. 2A, the nozzle plate 3 is in the form of plate having the rectangular shape. A surface of the nozzle plate 3 contacting with the cavity substrate 5 is a second surface 3*b* and a surface opposing the second surface 3*b* is a first surface 3*a*.

The nozzle holes 6 are disposed to align in one line at the nozzle plate 3. The number of the nozzle holes 6 and the number of arrangement thereof are not specifically limited, however, in the embodiment, for example, eleven nozzle holes 6 are arranged at the nozzle plate 3. The nozzle hole 6 is configured such that two holes of a nozzle outside hole 6*a* and a nozzle inside hole 6*b* having cylinder shapes with different diameters are disposed coaxially. The nozzle outside hole 6*a* is a hole which is smaller than the nozzle inside hole 6*b* in the diameter and disposed to open to the first surface 3*a*. Similarly, the nozzle inside hole 6*b* is disposed to open to the second surface 3*b*.

Furthermore, a pair of the positioning holes 7 are disposed at the nozzle plate 3. The positioning hole 7 consists of a first positioning hole 18 and a second positioning hole 19. The first positioning hole 18 is configured such that two holes are arranged coaxially which are a first outside depression 18*a* as a first depression, a positioning hole and a depression, and a first inside hole 18*b* as a second depression and a hole on the circumferences having different diameters. The first outside depression 18*a* is a depression that is larger than the first inside hole 18*b* in the diameter and arranged to open to the first surface 3*a*. Similarly, the first inside hole 18*b* is arranged to open to the second surface 3*b*.

The second positioning hole 19 is configured such that a second outside depression 19*a* as a first depression and a second inside hole 19*b* as a second depression and a hole are arranged in a stack. The second inside hole 19*b* is a rectangular shape in which a location where a side 19*d* and the side 19*d* intersect each other becomes an arc 19*e* in the plan view of the nozzle plate 3. The second outside depression 19*a* and the second inside hole 19*b* are similar in the planar shape and the second outside depression 19*a* has a shape that is larger than the second inside hole 19*b*. The second outside depression 19*a* is disposed to open to the first surface 3*a* and the second inside hole 19*b* is disposed to open to the second surface 3*b*.

Figure 2C:
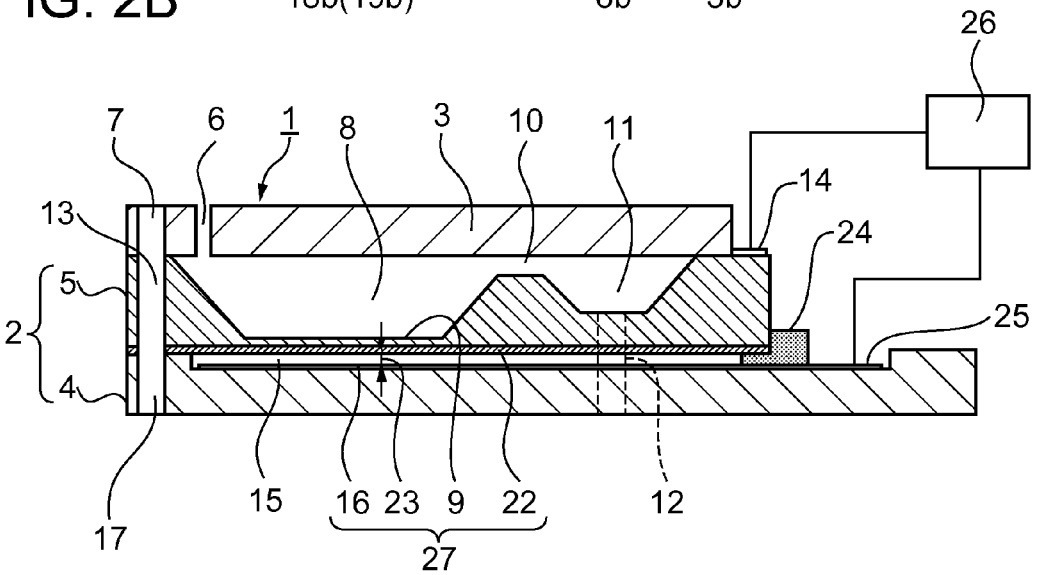

FIG. 2C is a schematic cross-sectional view illustrating a structure of the ink jet head. As shown in FIG. 2C, the liquid droplet discharge head 1 is configured such that the electrode substrate 4, the cavity substrate 5 and the nozzle plate 3 are disposed in this order in a stack. The ink is supplied from the ink introducing hole 12 to the reservoir 11. Each orifice 10 is connected to the reservoir 11 and the ink flows in the pressure chambers 8 through the orifices 10. Thus, the ink is discharged from the pressure chambers 8 to the outside air through the nozzle holes 6.

The depression 15 is formed at the electrode substrate 4 and the individual electrode 16 is disposed at the depression 15. In the cavity substrate 5, an insulation film 22 which is formed of a thermal oxide film of silicon is formed at a surface of the electrode substrate 4 side. Thus, a gap 23 is formed by the depression 15 between the individual electrode 16 and the insulation film 22. When the vibration plate 9 vibrates, the length of the gap 23 varies. Thus, even though the insulation film 22 comes into contact with the individual electrode 16, electricity does not flow between the insulation film 22 and the individual electrode 16.

A portion of the depression 15 is sealed in airtight by a sealant 24 such as epoxy resin or the like. Accordingly, moisture or particles of dust can be prevented from invading to the depression 15. One end of the individual electrode 16 is an electrode terminal 25 and the electrode terminal 25 is connected to a drive control circuit 26 such as a driver IC. Furthermore, the common electrode 14 communicating with the vibration plate 9 is also connected to the drive control circuit 26. Accordingly, the drive control circuit 26 can perform control of voltage which is applied between the vibration plate 9 and the individual electrode 16. Thus, an electrostatic actuator 27 is configured of the vibration plate 9 and the individual electrode 16 arranged opposing each other with a predetermined gap 23.

The drive control circuit 26 applies the voltage between the individual electrode 16 and the vibration plate 9. An electrostatic force is generated by applying of the voltage and the vibration plate 9 is pulled toward the individual electrode 16 side. Accordingly, inside the pressure chamber 8 becomes negative pressure and the ink inside the reservoir 11 flows into the pressure chamber 8. A meniscus vibration, which is a vibration of the ink, occurs in the nozzle holes 6 parallel with flowing of the ink. At a time point when the meniscus vibration becomes approximately the maximum, the drive control circuit 26 releases the voltage. Accordingly, the vibration plate 9 leaves from the individual electrode 16 and the ink is extruded from the nozzle holes 6 by a restoring force of the vibration plate 9. Thus, the liquid droplet discharge head 1 discharges ink droplets from the nozzle holes 6.

Figure 3:
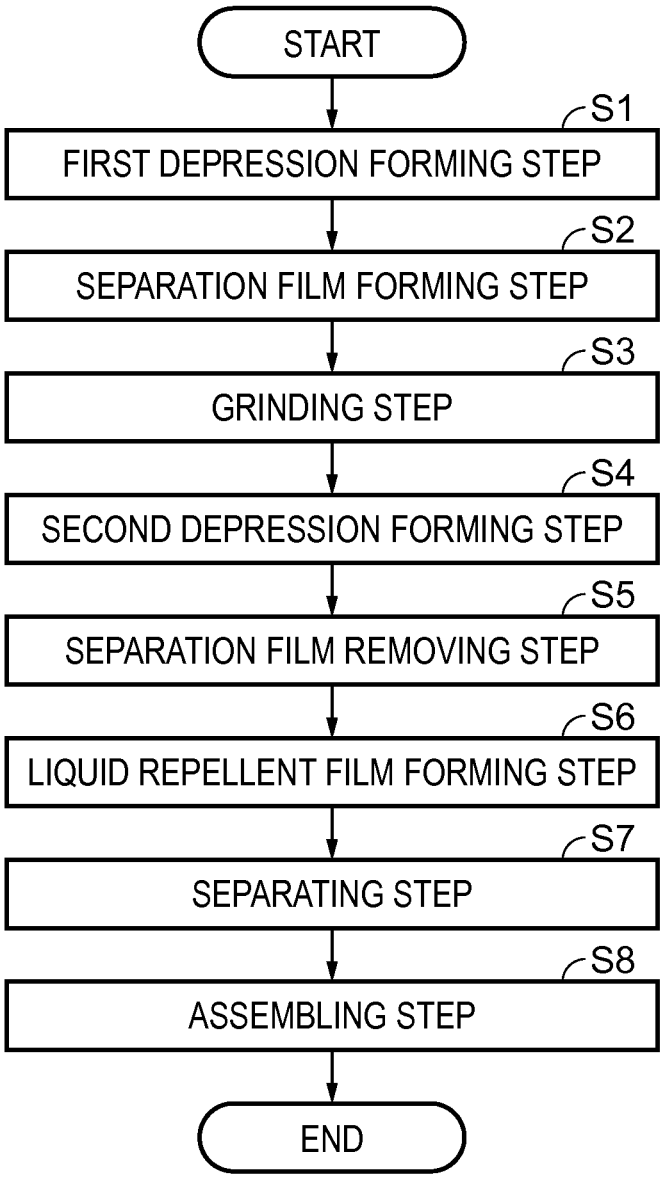
FIG. 3 is a flowchart of a method of manufacturing and a method of assembling of the nozzle plate.

Next, the method of manufacturing and the method of assembling of the nozzle plate 3 described above are described with reference to FIGS. 3 to 8B. FIG. 3 is a flowchart of the method of manufacturing and the method of assembling of the nozzle plate 3, and FIGS. 4A to 7E are diagrams to illustrate the method of manufacturing of the nozzle plate 3. FIGS. 8A and 8B are schematic diagrams to illustrate the method of assembling of the nozzle plate 3.

In the flowchart in FIG. 3, step S1 corresponds to a first depression forming step and is a step for forming the depression on the substrate. Then, the process proceeds to step S2. Step S2 corresponds to a separation film forming step and is a step for covering the substrate and forming a separation film. Then, the process proceeds to step S3. Step S3 corresponds to a grinding step and is a step for grinding the second surface side of the substrate and making the substrate to be the thin plate. Then, the process proceeds to step S4. Step S4 corresponds to the second depression forming step and is a step for forming the depression in the surface which has been ground. Then, the process proceeds to step S5. Step S5 corresponds to a separation film removing step and is a step for removing the separation film. Then, the process proceeds to step S6. Step S6 corresponds to a liquid repellent film forming step and is a step for covering the substrate and forming a liquid repellent film. Then, the process proceeds to step S7. Step S7 corresponds to a separating process and is a step for separating the nozzle plate from the substrate. Then, the process proceeds to step S8. Step S8 corresponds to an assembling process and is a step for fixing the nozzle plate on the cavity substrate. The liquid droplet discharge head 1 is completed by the steps described above.

Figure 4A:
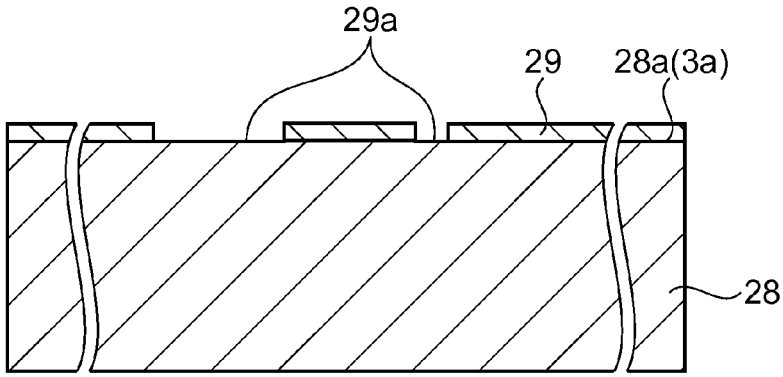
FIGS. 4A to 4D are schematic diagrams to illustrate the method of manufacturing of the nozzle plate.

Next, the method of manufacturing thereof is described in detail according to the steps shown in FIG. 3 using FIGS. 4A to 8B. FIGS. 4A to 4C are views according to the first depression forming step of step S1. As shown in FIG. 4A, in step S1, a silicon substrate 28 is prepared. The silicon substrate 28 may also be referred to as a silicon wafer. The thickness of the silicon substrate 28 is not limited, however, in the embodiment, for example, the thickness thereof is 725 μm. Thus, a resist 29 is coated and dried on one surface 28*a* of the silicon substrate 28 as a dry etching mask. Next, using a photolithographic method, the resist 29 is patterned and openings 29*a* are formed at locations which correspond to the locations of the nozzle outside hole 6*a*, the first outside depression 18*a*, and the second outside depression 19*a*. In addition, since the surface 28*a* finally becomes the first surface 3*a*, the surface 28*a* is referred to as the first surface 3*a*, hereinafter.

Figure 4B:
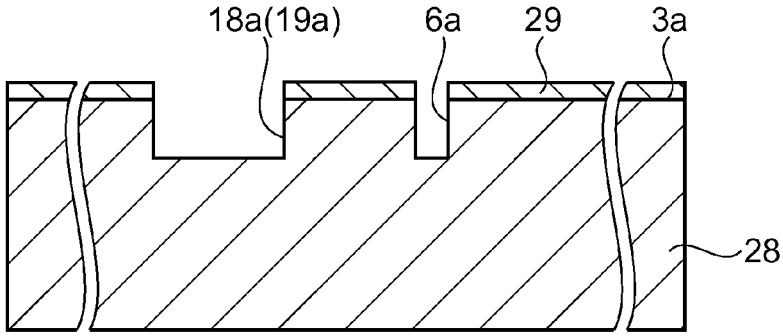

As shown in FIG. 4B, the anisotropic dry etching is performed vertically from the openings 29*a* of the resist 29 using an ICP (Inductive Coupled Plasma) dry etching device. Accordingly, the nozzle outside hole 6*a*, the first outside depression 18*a* and the second outside depression 19*a* are formed. In this case, for example, $C_4F_8$ and $SF_6$ can be used as etching gas, and these etching gases are used alternately. The $C_4F_8$ is used to protect the side surface against progress of the etching of the nozzle outside hole 6*a*, the first outside depression 18*a* and the second outside depression 19*a* in the side direction. The $SF_6$ is used to promote the etching of the silicon substrate 28 in the vertical direction.

Figure 4C:
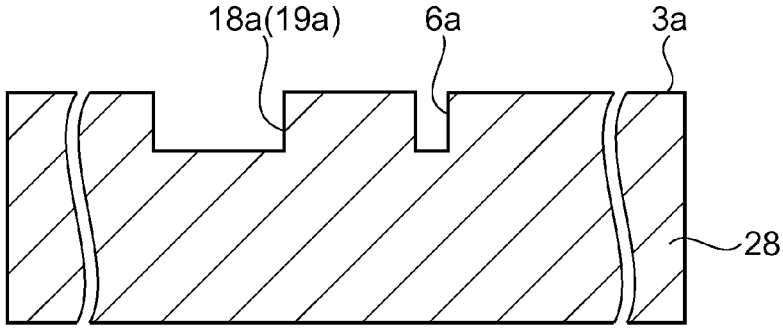

As shown in FIG. 4C, the resist 29 is peeled to be removed from the silicon substrate 28. In order to remove the resist 29, the silicon substrate 28 is cleaned using peeling liquid that is formed of aqueous sulfuric acid or the like. Then, the peeling liquid is removed by washing with pure water.

Figure 4D:
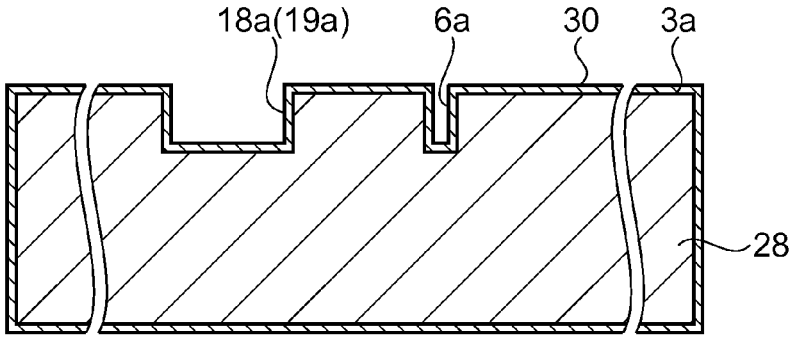

FIG. 4D is a view corresponding to the separation film forming step of step S2. As shown in FIG. 4D, in step S2, the silicon substrate 28 is input to a thermal oxidation furnace. Thus, a thermal oxide film 30 (a $SiO_2$ film) is formed on the entire surface of the silicon substrate 28 as the separation film. The thickness of the thermal oxide film 30 is not specifically limited, however, in the embodiment, for example, the thickness of the film is 0.1 μm. At this time, the thermal oxide film 30 is also formed on the nozzle outside hole 6*a*, the first outside depression 18*a* and the second outside depression 19*a*.

Figure 5A:
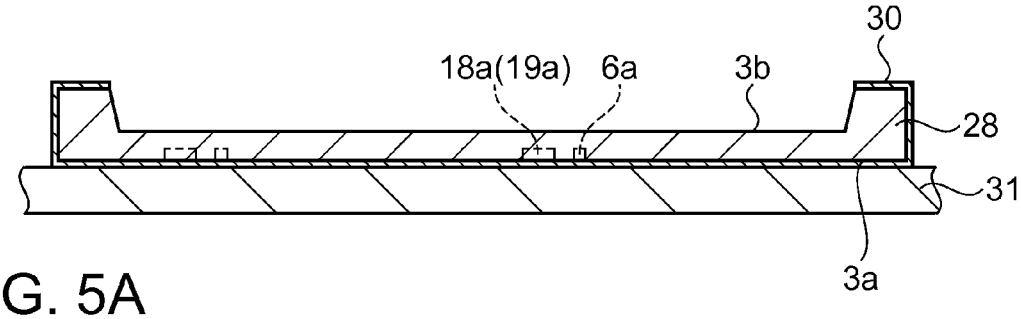
FIGS. 5A to 5C are schematic diagrams to illustrate the method of manufacturing of the nozzle plate.
Figure 5B:
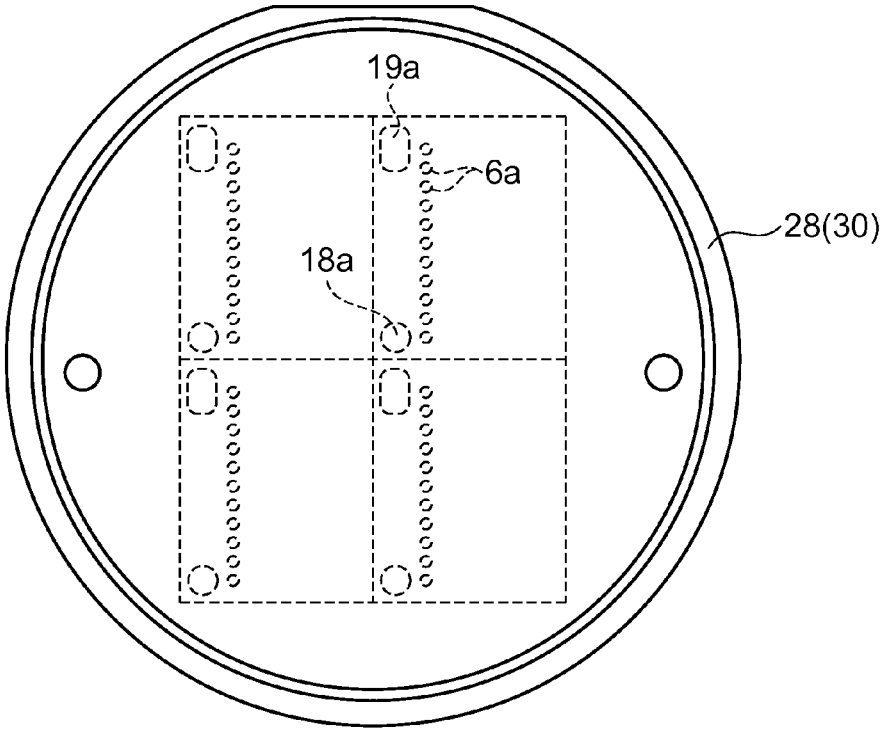

FIGS. 5A and 5B are views corresponding to the grinding step of step S3. FIG. 5A is a schematic side view of the silicon substrate and FIG. 5B is a schematic plan view of the silicon substrate. As shown in FIGS. 5A and 5B, in step S3, a supporting substrate 31 formed of transparent material such as glass is adhered to the first surface 3*a* of the silicon substrate 28 via a double-sided adhesive sheet. Specifically, a surface of a self peeling layer of the double-sided adhesive sheet which is adhered to the supporting substrate 31 and the silicon substrate 28 are faced to each other and adhered to each other in the vacuum. Accordingly, bonding can be performed without remaining bubbles on a bonding interface. When the bubbles remain on the bonding interface during bonding, it causes variation in the plate thickness when the silicon substrate 28 is thinned during the grinding.

Here, as the double-sided adhesive sheet, for example, Selfa BG (registered trademark: Sekisui Chemical Co., Ltd.) can be used. The double-sided adhesive sheet is a self peeling type sheet having the self peeling layer at one surface and has bonding surfaces on both surfaces thereof. The self peeling layer is decreased in the bonding force thereof by stimulation of ultraviolet light, heat or the like.

The silicon substrate 28 and the supporting substrate 31 are adhered to each other and thereby the silicon substrate 28 can be processed without being damaged when the silicon substrate 28 is processed to be the thin plate. In addition, after the grinding process, the supporting substrate 31 and the silicon substrate 28 are peeled. At this time, the supporting substrate 31 can be easily peeled without remaining adhesive at the silicon substrate 28. In addition, the peeling step of the supporting substrate 31 is not specifically limited to the step and the peeling may be performed at a later step.

The grinding step is performed from the opposite side of the first surface 3*a* of the silicon substrate 28 using a grinder, and the substrate is to be thinned to the predetermined thickness of the plate. The thermal oxide film 30 is also cut at the location which has been ground. The surface that is parallel to the first surface 3*a* becomes the second surface 3*b* at the location which has been ground.

In the method of manufacturing of the related art, during the grinding process, there is a problem that chipping occurs at the periphery of the nozzle outside hole 6*a*. In the method of manufacturing of the embodiment, after forming the nozzle outside hole 6*a*, the grinding process is performed from the opposite side of the nozzle outside hole 6*a*. Thus, after the grinding process is performed, the nozzle inside hole 6*b* is formed. Thus, chipping occurs neither in the nozzle outside hole 6*a*, nor in the nozzle inside hole 6*b*. Accordingly, the nozzle holes 6 can be formed in high quality.

Figure 5C:
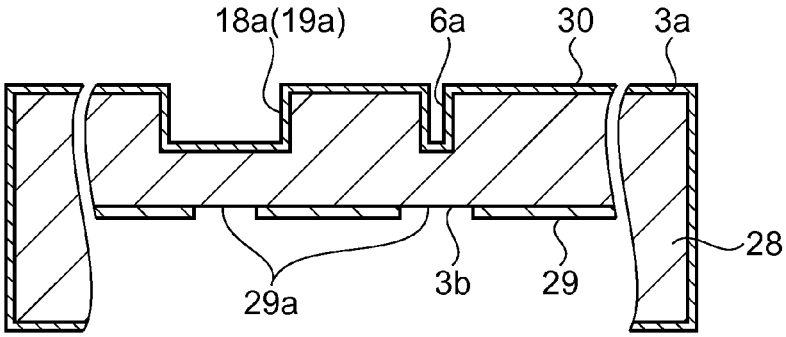

FIGS. 5C to 6D are views according to the second depression forming step of step S4. As shown in FIG. 5C, in step S4, the resist 29 as the dry etching mask is coated and dried on the second surface 3*b* of the silicon substrate 28. Next, using the photolithographic method, the resist 29 is patterned and openings 29*a* are formed at locations which correspond to the nozzle inside hole 6*b*, the first inside hole 18*b*, and the second inside hole 19*b*.

Figure 6A:
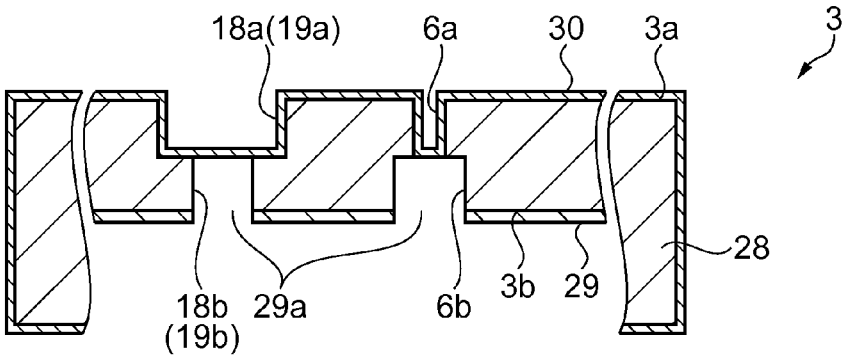
FIGS. 6A to 6C are schematic diagrams to illustrate the method of manufacturing of the nozzle plate.

As shown in FIG. 6A, the anisotropic dry etching is performed vertically from the openings 29*a* of the resist 29 using the ICP dry etching device. Accordingly, the nozzle inside hole 6*b*, the first inside hole 18*b* and the second inside hole 19*b* are formed. In this case, for example, $C_4F_8$ and $SF_6$ can be used as the etching gas, and these gases are used alternately. The $C_4F_8$ is used to protect the side surface against the progress of the etching of the nozzle inside hole 6*b*, the first inside hole 18*b* and the second inside hole 19*b* in the side direction. The $SF_6$ is used to promote the etching of the silicon substrate 28 in the vertical direction.

Figure 6B:
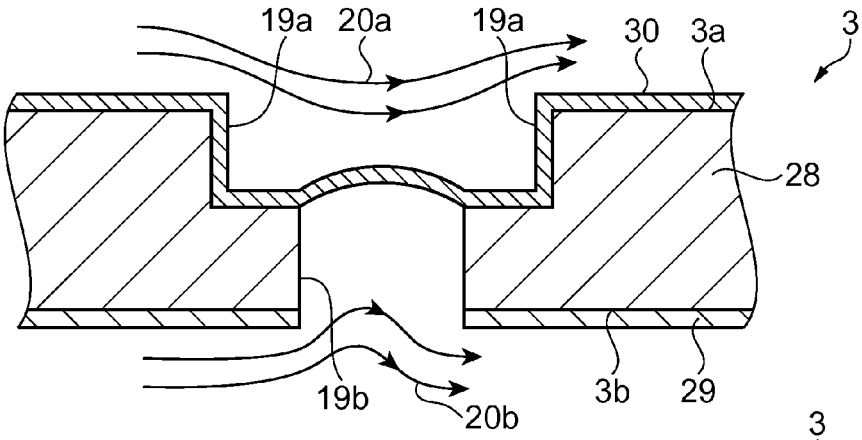
Figure 6C:
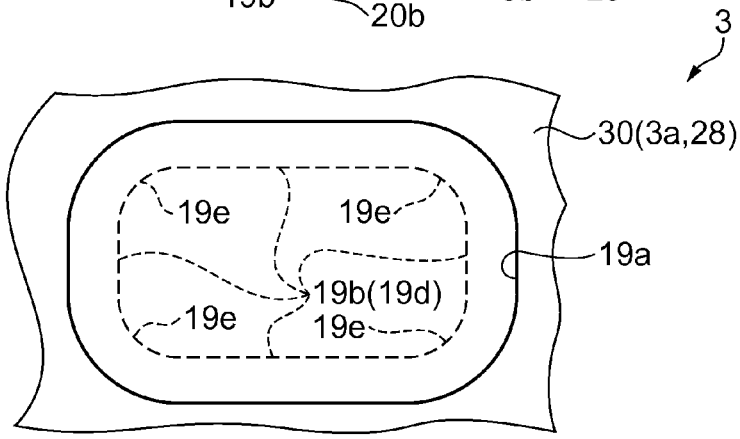

FIG. 6B is an enlarged schematic cross-sectional view of the second positioning hole 19 and FIG. 6C is an enlarged schematic plan view of the second positioning hole 19. As shown in FIGS. 6B and 6C, the second inside hole 19*b* of the silicon substrate 28 is positioned inside the second outside depression 19*a* in the plan view. Thus, etching gas 20*b* flows in the second inside hole 19*b* side and cooling gas 20*a* flows in the second outside depression 19*a* side. Pressure is applied to the thermal oxide film 30 by the cooling gas 20*a* and the etching gas 20*b*. Thus, pressure is applied to the thermal oxide film 30 from the second inside hole 19*b* where pressure is high. Accordingly, the thermal oxide film 30 expands.

When pressure is not applied, the thermal oxide film 30 is a flat film, and when applied, the thermal oxide film 30 becomes an arc shape. Accordingly, since the thermal oxide film 30 has a structure that does not concentrate the stress, the thermal oxide film 30 cannot be easily torn. In the embodiment, in the planar shape of the second inside hole 19*b*, the location where the side 19*d* and the side 19*d* of the rectangular-shape intersect to each other becomes the arc 19*e*. Accordingly, since a difference between a location where inner stress of the thermal oxide film 30 is high and a location where the inner stress thereof is low can be decreased, the thermal oxide film 30 cannot be easily stretched.

Figure 6D:
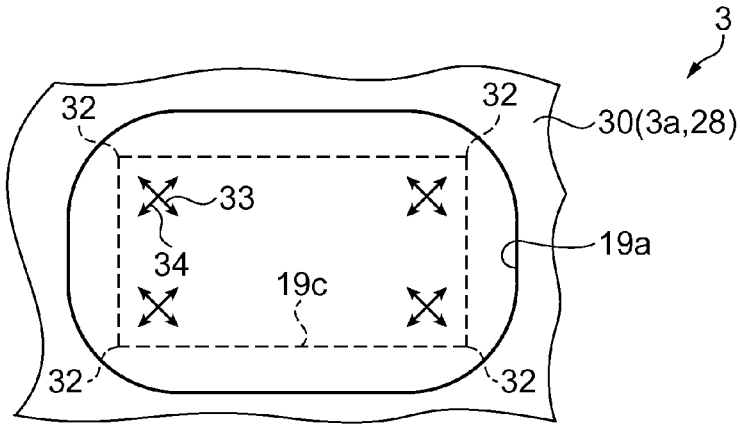
FIG. 6D is a schematic plan view in a case where a second inside hole is a rectangular shape in relation with a comparison example.

FIG. 6D is a comparison example and a schematic plan view in a case where the second inside hole is a rectangular shape. In FIG. 6D, a second inside hole 19*c* is the rectangular shape in the planar shape and the location where the side and the side intersect to each other becomes an angle 32. Thus, a direction of a bisector of the angle 32 is referred to as a first direction 33 and a direction orthogonal to the first direction 33 is referred to as a second direction 34. At this time, the thermal oxide film 30 is further stretched to the direction of the second direction 34 compared to the first direction 33 in the vicinity of the angle 32. Accordingly, the thermal oxide film 30 is easily torn at the vicinity of the angle 32.

Figure 7A:
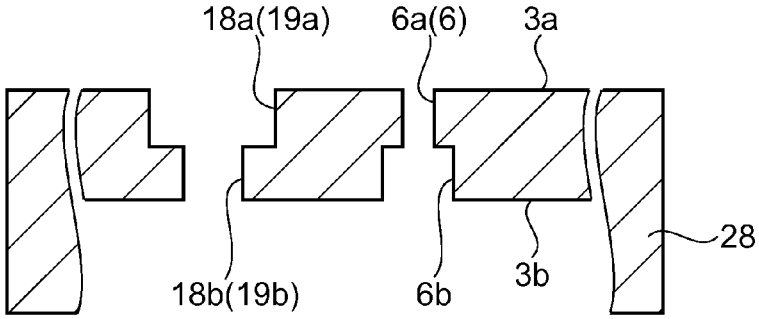
FIGS. 7A to 7E are schematic diagrams to illustrate the method of manufacturing of the nozzle plate.
Figure 8A:
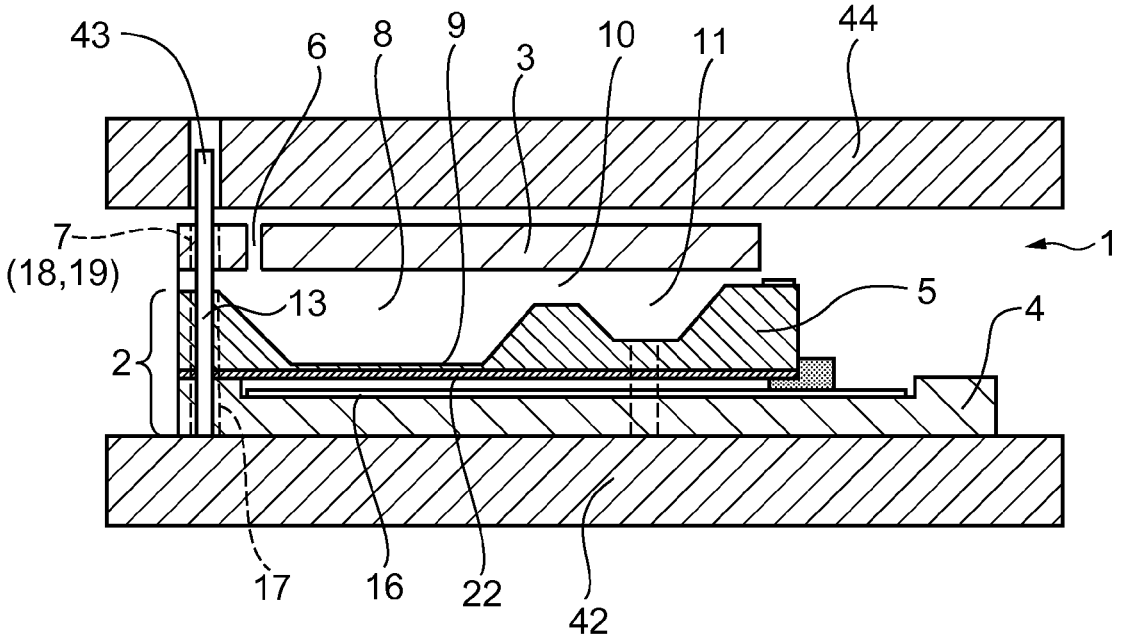
FIGS. 8A and 8B are schematic diagrams to describe the method of assembling of the nozzle plate.
Figure 8B:
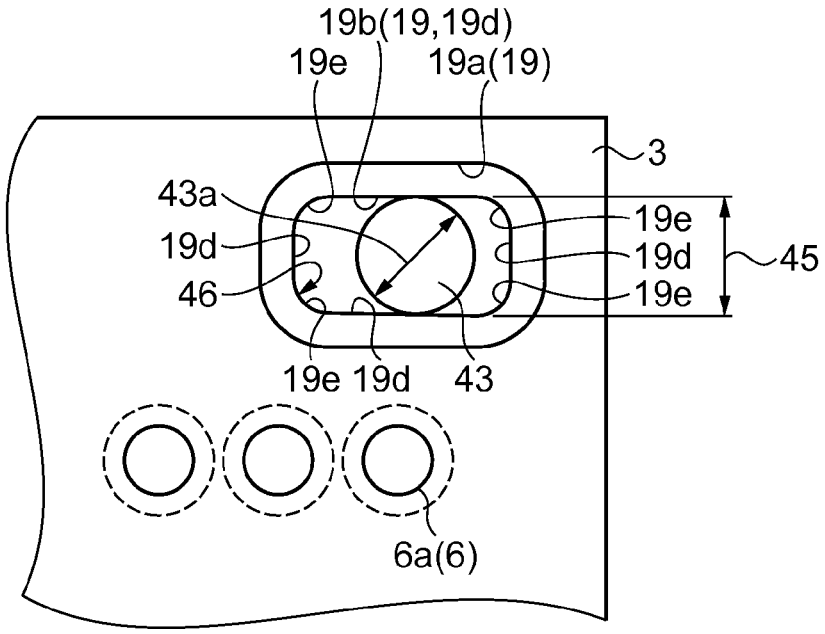

FIG. 7A is a view according to the separation film removing step of step S5. As shown in FIG. 7A, in step S5, the resist 29 and the thermal oxide film 30 are peeled to be removed from the silicon substrate 28. In order to remove the resist 29 and the thermal oxide film 30, the silicon substrate 28 is cleaned using the peeling liquid that is formed of aqueous sulfuric acid or the like. Then, the peeling liquid is removed by washing with the pure water.

Figure 7B:
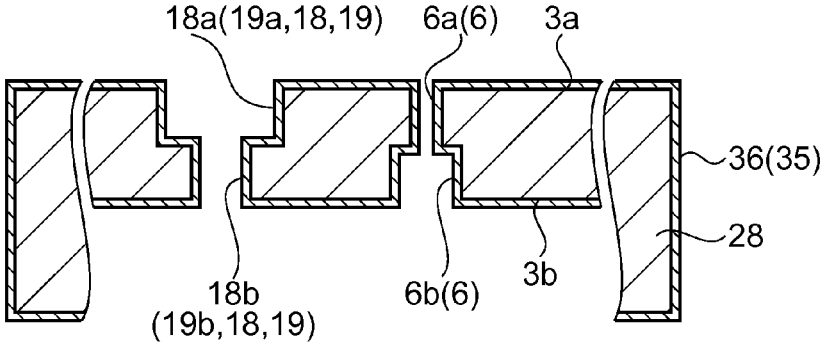

FIG. 7B is a view according to the liquid repellent film forming step of step S6. As shown in FIG. 7B, in step S6, a process is performed which provides ink resistant property and ink repellent property to the entire surface of the silicon substrate 28 for the ink. In other words, a thermal oxide film 35 of the silicon and a liquid repellent film 36 are formed on the entire surface of the silicon substrate 28 including inside walls of the nozzle holes 6, the first positioning hole 18 and the second positioning hole 19.

First, the silicon substrate 28 is input into the thermal oxidation furnace and thereby the thermal oxide film 35 for example, of the thickness of the film of 0.1 μm is formed on the entire surface of the silicon substrate 28. The thermal oxide film 35 is $SiO_2$ film and is formed on the inside wall of the nozzle holes 6. Next, the silicon substrate 28 is cleaned. When cleaning, since the openings of the nozzle holes 6 are penetrated without being clogged by the supporting substrate, the cleaning inside the nozzle holes 6 can be carried out well.

Subsequently, a material having liquid repellent property of which a main component is a silicon compound including fluorine atoms provides a film with depositing or dipping and thereby the liquid repellent film 36 is formed. At this time, the nozzle holes 6 are configured such that the liquid repellent films 36 are formed inside walls of the nozzle outside hole 6*a* and the nozzle inside hole 6*b*.

Figure 7C:
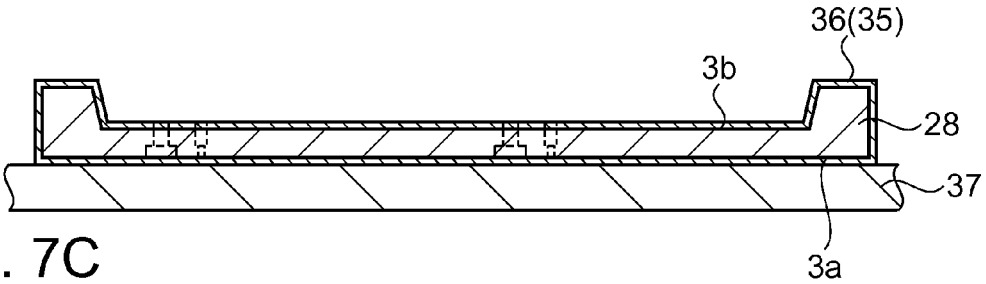
Figure 7D:
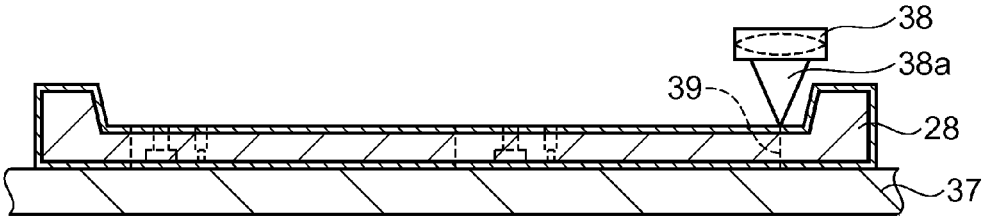
Figure 7E:
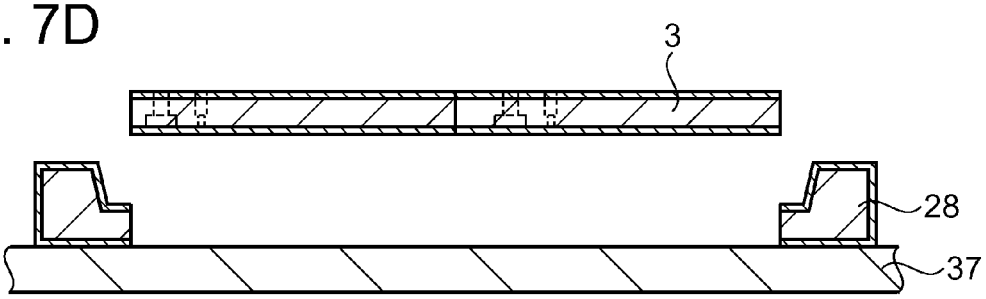

FIGS. 7C to 7E are views according to the separating step of step S7. As shown in FIG. 7C, in step S7, a dicing tape 37 is adhered at the first surface 3*a* side of the silicon substrate 28. Next, as shown in FIG. 7D, a laser beam 38*a* is irradiated along a line which will separate the silicon substrate 28 from a laser irradiation device 38. At this time, the laser beam 38*a* is collected and irradiated and thereby a reforming portion 39 is formed inside the silicon substrate 28. An array structure of the silicon atoms is varied in the reforming portion 39 and thereby the reforming portion 39 of the silicon substrate 28 can be fragile. Thus, the reforming portion 39 is arranged along the line which will separate the silicon substrate 28 and thereby a surface of the reforming portion 39 is formed.

Next, as shown in FIG. 7E, the stress is applied along the surface where the reforming portion 39 is formed. Accordingly, the silicon substrate 28 is divided and each nozzle plate 3 is separated. Thus, the nozzle plate 3 is peeled from the dicing tape 37. The nozzle plate 3 is completed with the steps described above.

FIGS. 8A and 8B are views according to the assembling step of step S8. As shown in FIG. 8A, in step S8, the flow path forming substrate 2 and the nozzle plate 3 are prepared. The flow path forming substrate 2 is configured such that the electrode substrate 4 and the cavity substrate 5 are fixed by contacting a cathode. A method of manufacturing of the flow path forming substrate 2 is known and the description thereof is omitted. Furthermore, a base plate 42 that is a jig for assembling, two positioning pins 43 and a pressing plate 44 are prepared.

First, two positioning pins 43 are erected on the base plate 42. Next, the adhesive is coated at the location which contacts with the nozzle plate 3 on the cavity substrate 5. A method of coating of the adhesive is not specifically limited, and offset printing, screen printing, ink jet method or the like can be used. Subsequently, the positioning pins 43 penetrate the positioning hole 17 and the positioning hole 13 and thereby the flow path forming substrate 2 is disposed on the base plate 42. Next, the positioning pins 43 penetrate the first positioning hole 18 and the second positioning hole 19 of the nozzle plate 3 respectively, and thereby the nozzle plate 3 is disposed on the flow path forming substrate 2.

Subsequently, the nozzle plate 3 is pressed by the pressing plate 44 and is heated. Accordingly, the flow path forming substrate 2 and the nozzle plate 3 are bonded. Accordingly, each of the nozzle holes 6 of the nozzle plate 3 and the pressure chamber 8 of the flow path forming substrate 2 are positioned in high precision so as to communicate with each other at the appropriate position.

As shown in FIG. 8B, the second inside hole 19*b* is a rectangular shape and a diameter 43*a* of the positioning pin 43 has the same length as a width 45 of the second inside hole 19*b* in the short side direction. Accordingly, the positioning pins 43 and the nozzle plate 3 are restricted in the relative position in the short side direction thereof.

The location where two sides 19*d* adjacent to each other of the second inside hole 19*b* intersect becomes the arc 19*e*. Thus, a radius 46 of the arc 19*e* is smaller than that of the positioning pin 43. Accordingly, in the second inside hole 19*b*, a diameter of the arc 19*e* is formed shorter than the width 45. At this time, when the positioning pins 43 approach the short side of the second inside hole 19*b*, the positioning pins 43 come into contact with the short side without contacting the arc 19*e*. As a result, the positioning pins 43 can be moved to all locations of the second inside hole 19*b* in the longitudinal direction. The liquid droplet discharge head 1 is completed by the steps described above.

Comparison Example

Figure 9A:
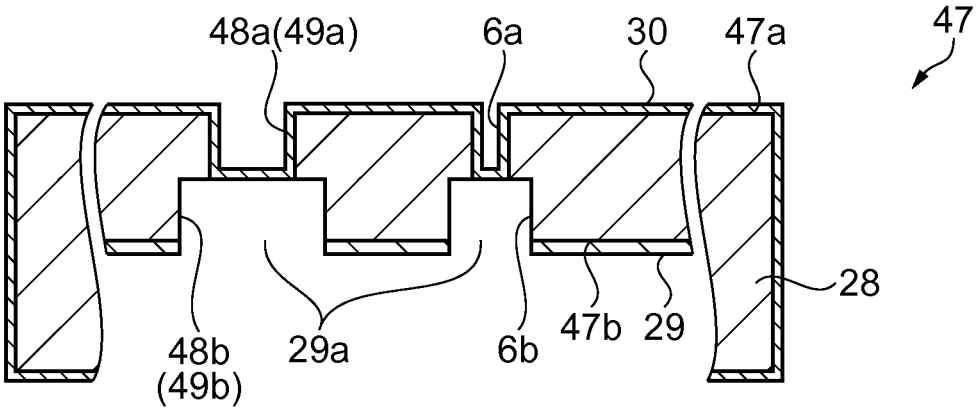
FIGS. 9A and 9B are schematic cross-sectional views of the nozzle plate in relation with a comparison example.
Figure 9B:
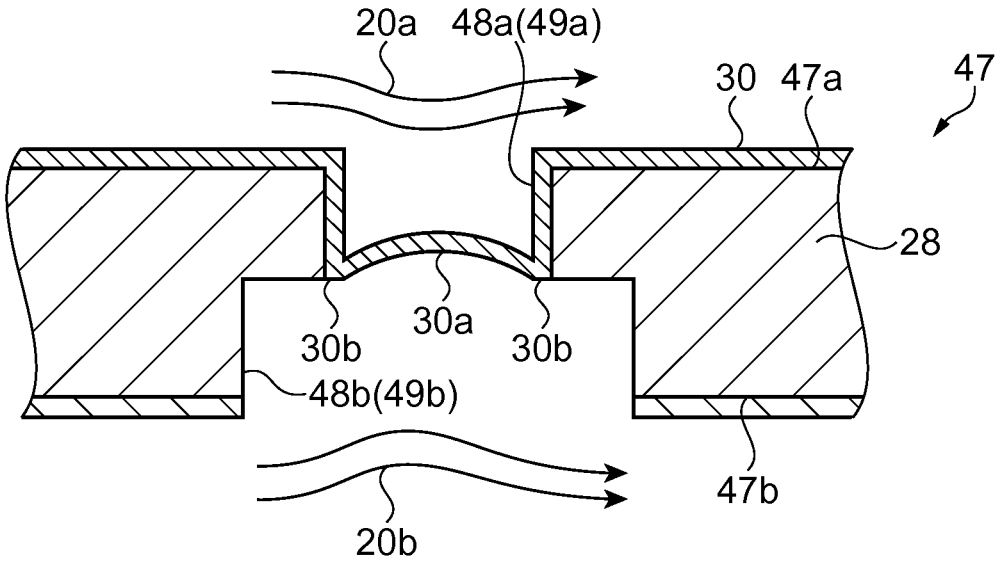

FIGS. 9A to 9B are schematic cross-sectional views of the nozzle plate in a comparison example and diagrams to illustrate the second depression forming step of step S4. FIG. 9A illustrates the entire nozzle plate and FIG. 9B illustrates the second positioning hole. A nozzle plate 47 is configured such that the nozzle outside hole 6*a* is formed at a first surface 47*a* of the silicon substrate 28. Furthermore, a first outside depression 48*a* and a second outside depression 49*a* are formed at the first surface 47*a*. The first outside depression 48*a* corresponds to the first outside depression 18*a* and the second outside depression 49*a* corresponds to the second outside depression 19*a*.

The silicon substrate 28 is to be the thin plate and the resist 29 coats on a second surface 47*b*. Thus, the openings 29*a* are patterned and the etching is performed in the nozzle inside hole 6*b*, a first inside hole 48*b* and a second inside hole 49*b*.

As shown in FIG. 9B, the first outside depression 48*a* is smaller than the first inside hole 48*b* in the planar shape. Thus, when the etching of the first inside hole 48*b* is processed from the second surface 47*b* side, the thermal oxide film 30 is formed so as to remain between the first outside depression 48*a* and the first inside hole 48*b*. In the thermal oxide film 30, a portion partitioning the first outside depression 48*a* and the first inside hole 48*b* is referred to as a partition 30*a*. Thus, the locations where the first outside depression 48*a* and the partition 30*a* intersect to each other are referred to as peripheral portions 30*b*.

A pressure corresponding to a difference between the etching gas 20*b* and the cooling gas 20*a* is applied to the partition 30*a* of the thermal oxide film 30. Thus, the partition 30*a* is deformed in an arc shape. Since the peripheral portions 30*b* are formed in a right angle, when the partition 30*a* is deformed in the arc shape, the peripheral portions 30*b* become an acute angle. At this time, the stress acts so that the peripheral portions 30*b* of the first inside hole 48*b* side expand. Accordingly, when pressure applying to the partition 30*a* varies, the peripheral portions 30*b* are easily torn.

Similarly, the thermal oxide film 30 is also easily torn between the second outside depression 49*a* and the second inside hole 49*b*. In the embodiment, the peripheral portions 30*b* are planar shape. Accordingly, the nozzle plate 3 can prevent the thermal oxide film 30 from tearing.

As described above, according to the embodiment, the invention has the following effects.

(1) According to the embodiment, in the second depression forming step of step S4, pressure is applied to the thermal oxide film 30 by the cooling gas 20*a* and the etching gas 20*b*. Thus, the thermal oxide film 30 is pressurized at the high pressure side. Accordingly, the thermal oxide film 30 extends. When the second inside hole 19*b* is a quadrangle shape in the plan view, the portion of the angle 32 is stretched compared to the portion of the side. Accordingly, the location having high inside stress and the location having low inside stress are formed at the thermal oxide film 30. In the embodiment, the location where the side 19*d* and the side 19*d* of the quadrangle shape intersect becomes the arc 19*e*. Accordingly, the portion of the arc 19*e* cannot be easily stretched compared to when the location where the side 19*d* and the side 19*d* intersect becomes angular. Accordingly, the difference between the location having high inside stress and the location having low inside stress of the thermal oxide film 30 can be decreased. The difference between the location having high inside stress and the location having low inside stress of the separation film can be decreased even when the first inside hole 18*b* is a circle shape in the plan view. As a result, the thermal oxide film 30 cannot be easily torn.

(2) According to the embodiment, the first inside hole 18*b* of the silicon substrate 28 is positioned inside the first outside depression 18*a* in the plan view. Since the thermal oxide film 30 is formed at the first outside depression 18*a*, the first surface 3*a* side of the first inside hole 18*b* reaches the thermal oxide film 30 in the second depression forming step of step S4. At this time, pressure is applied to the thermal oxide film 30 formed in the planar shape.

Meanwhile, when the first inside hole 18*b* of the substrate is positioned at the first outside depression 18*a* and the location of the outside of the first outside depression 18*a* in the plan view, the first surface 3*a* side of the first inside hole 18*b* becomes the outside portion of the first outside depression 18*a* and the thermal oxide film 30. Accordingly, the thermal oxide film 30 of the location where the side surface of the first outside depression 18*a* and the surface of the second surface 3*b* side of the first outside depression 18*a* intersect is also included in the first surface 3*a* side of the first inside hole 18*b*. At this time, the thermal oxide film 30 of the location where the side surface of the first outside depression 18*a* and the surface of the second surface 3*b* side of the first outside depression 18*a* intersect is easily torn because the stress thereof is easily concentrated. Compared to the structure, in the structure of the embodiment, since pressure is applied to the thermal oxide film 30 formed in the planar shape, the stress concentration hardly occurs and the film cannot be easily torn. The contents also have the same effects in the second positioning hole 19.

(3) According to the embodiment, the positioning pin 43 is inserted in the second inside hole 19*b* and is used for positioning of the nozzle plate 3. Thus, the diameter of the arc 19*e* is shorter than the width 45 of the rectangular shape in the short side direction. Thus, the diameter of the positioning pin 43 is set to approximately the same length as the width 45 of the rectangular shape in the short side direction. Accordingly, when the positioning pin 43 approaches the short side of the rectangular shape, the positioning pin 43 comes into contact with the short side without contacting the arc 19*e*. As a result, the second inside hole 19*b* can move the positioning pin 43 to all locations of the rectangular shape in the longitudinal direction.

(4) According to the embodiment, the positioning hole 7 and the nozzle holes 6 can be manufactured in the same step. Accordingly, the nozzle plate 3 can be manufactured with good productivity compared to when the positioning hole 7 and the nozzle holes 6 are manufactured in separate steps respectively.

(5) According to the embodiment, the thermal oxide film 30 separates the first outside depression 18*a* and the first inside hole 18*b*. Similarly, the thermal oxide film 30 separates the second outside depression 19*a* and the second inside hole 19*b*. Accordingly, the etching gas and the cooling gas can be prevented from mixing. As a result, the etching can be performed in high quality.

In addition, the embodiment is not limited to the embodiment described above, and various changes and improvements may be added. Modification examples are described below.

Modification Example 1

In the first embodiment, the thermal oxide film 30 is the separation film. The separation film may be formed by methods of a CVD, a sputtering or the like. At this time, the material of the separation film is not limited to $SiO_2$, various metals or inorganic matter can be used. Thus, the step may be applied to simplify manufacture.

Modification Example 2

In the first embodiment, the first positioning hole 18 is the circle shape in the planar shape, however, the shape may be a polygon such as hexagon, heptagon, or octagon. When the positioning pin 43 inserts into the first positioning hole 18, the sides of the polygon can be deformed and thereby manufacturing error in the dimension can be permitted.

Modification Example 3

In the first embodiment, the nozzle plate 3 is described as an example, however, even in the other substrates, the holes having different sizes may be formed using the same method thereof. The method may be used in various kinds of substrates other than the electrode substrate 4 and the cavity substrate 5. Even in this case, the separation film cannot be easily torn.

The entire disclosure of Japanese Patent Application No. 2011-138235, filed Jun. 22, 2011 is expressly incorporated by reference herein.

What is claimed is:

1. A nozzle plate comprising:

a first surface that has a plurality of holes through which liquid is discharged;

a second surface that is opposite to the first surface;

a first depression that is provided in the first surface; and a second depression that is provided in the second surface, wherein a second perimeter of the second depression is less than a first perimeter of the first depression, the second perimeter is positioned inside the first perimeter in a plan view of the first and second surfaces, and wherein the first and second depressions are spaced apart from the plurality of holes.

2. The nozzle plate according to claim 1, wherein the nozzle plate includes silicon.

3. An ink jet head including the nozzle plate according to claim 1.

4. An ink jet head including the nozzle plate according to claim 2.

5. The nozzle plate according to claim 1, wherein the second perimeter is defined by a plurality of straight line segments and arcs.

6. The Nozzle plate according to claim 1, wherein the second depression is a positioning part that positions other components.

* * * * *